United States Patent [19]

Dumond

[11] 4,228,904

[45] Oct. 21, 1980

[54] STAIRSTEP DISPLAY RACK

[75] Inventor: Vernon Dumond, Redfield, Ark.

[73] Assignee: Champion International Corporation, Stamford, Conn.

[21] Appl. No.: 943,046

[22] Filed: Sep. 18, 1978

[51] Int. Cl.[2] ..... A47F 7/00; B65D 5/50

[52] U.S. Cl. ..... 211/55; 40/124.2; 206/45; 211/73; 248/174

[58] Field of Search ..... 211/52, 55, 56, 72, 211/73, 128; 40/124, 124.1, 124.2; 206/45, 45.14, 45.19; 248/174, 220.4

[56] References Cited

U.S. PATENT DOCUMENTS

| | | | |
|---|---|---|---|
| 740,321 | 9/1903 | Shaul | 40/124 X |
| 965,019 | 7/1910 | Schandein et al. | 211/55 X |
| 1,562,977 | 11/1925 | Levigton | 206/45.19 X |
| 1,692,324 | 11/1928 | Averill | 211/130 X |
| 1,949,376 | 2/1934 | Mansfield et al. | 206/45.14 |
| 1,974,552 | 9/1934 | Wallbank | 206/45 |
| 2,104,523 | 1/1938 | Lichtenstein | 211/72 X |
| 2,300,411 | 11/1942 | Dobey | 206/45.14 |
| 2,914,184 | 11/1959 | Dgetluck | 211/55 |
| 3,340,998 | 9/1967 | Wilson | 248/174 X |
| 4,081,080 | 3/1978 | Rorex | 211/55 |

FOREIGN PATENT DOCUMENTS

| | | | |
|---|---|---|---|
| 503467 | 6/1951 | Belgium | 206/45.14 |
| 658773 | 5/1965 | Belgium | 248/174 |
| 81984 | 10/1956 | Denmark | 40/124.2 |
| 1501813 | 10/1967 | France | 206/45.14 |

*Primary Examiner*—Thomas J. Holko
*Attorney, Agent, or Firm*—Evelyn M. Sommer

[57] ABSTRACT

A display rack for a counter top display provides a stairstep effect and is adaptable to a wide variety of display styles and products. The rack includes an outer casing, a support member and a plurality of pockets. The support member has a planar support panel which is inclined when the support member is folded and mounted within the outer casing. Each pocket has depending legs which are mounted within aligned slots in the support panel so as to be arranged in a stairstep manner. The casing, support member and pocket are each in the form of a flat, planar sheet of material which is folded to its assembled configuration.

11 Claims, 11 Drawing Figures

STAIRSTEP DISPLAY RACK

The present invention relates to a stairstep display rack for displaying products on a counter top. More particularly, the present invention relates to a stairstep display rack having a generally planar support panel which is mounted in an outer casing so as to be inclined relative to the counter top and which has a plurality of aligned slots for retaining at least one pocket on the inclined support panel.

Known and conventional counter top display racks which provide a stairstep effect require the use of multi-scored, reverse folded and slotted die cut support members and the use of various styles of die cut partitions and/or pads to secure the various parts together. Such display racks are disadvantageous in that they require preassembly outside the display area, and require intricate cutting and folding operations. Additionally, these prior art display racks may not be adapted easily to a wide variety of products and the parts thereof must be made small, thereby greatly reducing the strength of the rack. Typical examples are U.S. Pat. Nos. 2,688,408, Binggely; 2,801,754, Dorfman; and 2,914,184, Dgetluck.

Accordingly, it is an object of the present invention to provide a stairstep display rack which may be assembled from flat unitary sheets of material without preassembly. In particular, it is the object of the present invention to provide a stairstep display rack which has an inclined, generally planar, support surface mounted in an outer casing, a plurality of aligned slots in the support panel, and at least one pocket for receiving items to be displayed insertable within the aligned slots to create the stairstep effect.

Another object of the present invention is to provide a stairstep display rack which may be assembled on location from parts formed as flat unitary sheets to facilitate storing and shipping.

A further object of the present invention is to provide a stairstep display rack which is strong, reusable, simple to assemble, inexpensive and easy to manufacture, and adaptable to a wide variety of display arrangements and products.

The foregoing objects are attained by providing a stairstep display rack for displaying items in a stairstep arrangement on a horizontal surface comprising an outer casing, a support member adapted to be mounted within the casing with the member having a generally planar support panel, means for supporting the support panel so that it is inclined relative to the horizontal surface and exposed in the casing when the member is mounted in the casing and a plurality of aligned slots in the support panel, and at least one pocket means for receiving a quantity of items to be displayed adapted to be mounted in at least one of the aligned slots by a downwardly extending leg on the pocket means, with the casing, support member and pocket means each being in the form of a flat, planar sheet of material which may be folded to its assembled configuration to permit storage and shipping of the rack in a flat configuration and simple assembly on location without preassembly.

Other objects, advantages, and salient features of the present invention will become apparent from the following detailed description, which, when taken in conjunction with the annexed drawings, discloses a preferred embodiment of the present invention.

Referring to the drawings which form a part of this disclosure:

Figure 1:
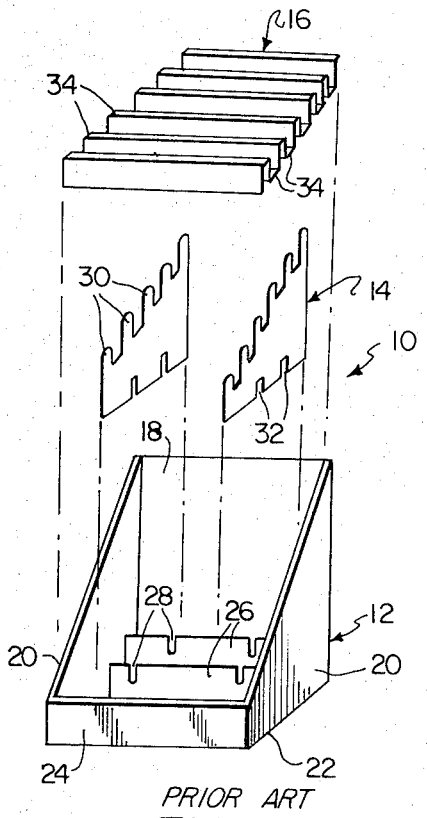
PRIOR ART FIG. 1
FIG. 1 is an exploded, perspective view illustrating a conventional stairstep display rack.

Referring to FIG. 1, a known and conventional type of stairstep display rack 10 is illustrated. The rack 10 includes an outer casing 12, support members 14 and a nonplanar support panel 16. The outer casing 12 has a back panel 18, side panels 20, a bottom panel 22 and a front panel 24. Two support beams 26 are fixed on the bottom panel 22 and have aligned slots 28 therein extending inwardly from the upper edge thereof.

The support members 14 are formed in the general shape of a right triangle. The hypotenuse of that triangle is provided with a plurality of upwardly extending teeth 30. The lower edges of the support members 14 have upwardly extending slots 32 for mating with the slots 28. The engagement of the slots 28, 32 and the portions of beams 26 and members 14 adjacent thereto, attaches the support members 14 within the outer casing 12.

The support member 16 contains a plurality of intricate reverse bends 34 so as to provide a stairstep effect. The teeth 30 of the support members 14 support the nonplanar support member 16 within the casing 12.

Figure 2:
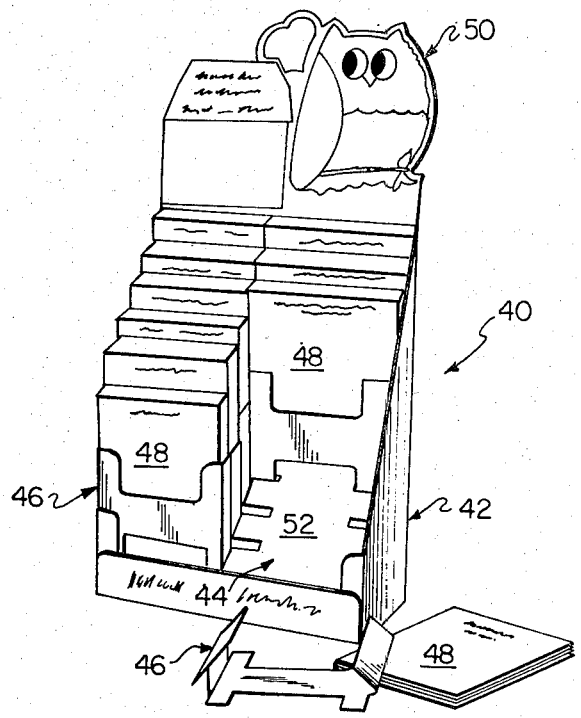
FIG. 2 is an perspective view illustrating a stairstep display rack in accordance with the present invention which is fully assembled with articles to be displayed therein.
Figure 3:
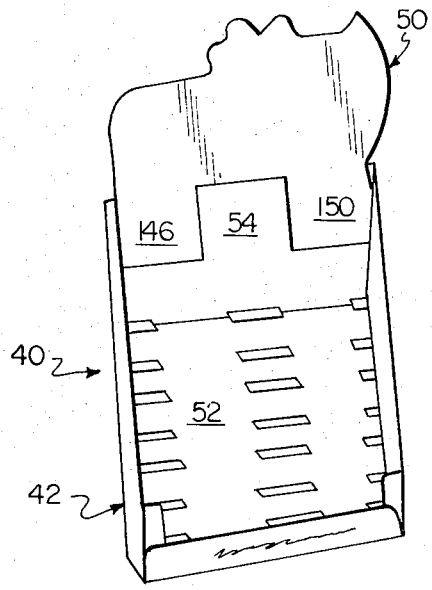
FIG. 3 is a perspective view illustrating a partially assembled rack of the present invention in which the pocket means and display items have been omitted.
Figure 4:
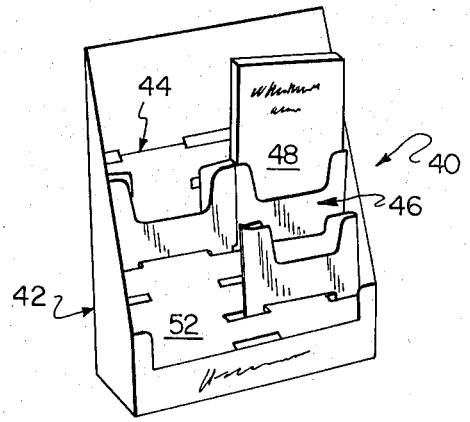
FIG. 4 is a perspective view illustrating a partially assembled rack in accordance with the present invention.

Referring now to FIGS. 2–4, the stairstep display rack 40 comprises an outer casing 42, a support member 44 and a pocket structure 46 for retaining and displaying items 48 in a stairstep manner. A header card 50 may be coupled to the outer casing 42.

The support member 44 has a planar support panel 52 and is so mounted within the outer casing 42 that the support panel 52 is oriented at an angle relative to a counter top (not shown) upon which the display rack 40 is placed. The pockets 46 are mounted on the support panel 52 and are arranged in a line extending up the incline of the support panel 52 so as to be oriented relative to one another in a stairstep manner. When items 48 are placed within the pockets 46, the items 48 will be displayed in a stairstep arrangement. The items 48 may include books, pamphlets, magazines, pictures, cards, seed packages or any product packaged in envelopes.

The details of the outer casing 42 will be discussed with reference to FIGS. 5 and 6. The outer casing 42 comprises a generally rectangular back panel 54, a generally rectangular bottom panel 56, two side panels 58, and a front panel 60. The entire outer casing 42 is assembled from the blank illustrated in FIG. 5 which is in the form of a flat single unitary sheet of material.

The side panels 58 are attached to the back panel 54 along the opposite side edges thereof. First and second fold lines 62, 64 extend between and along the entire length of the junctures of the side panels 58 and the back panel 54. The bottom panel 56 is attached to the back panel 54 at a lower edge of the back panel 54. A third fold line 66 extends between and along the entire length of the juncture between the back panel 54 and the bottom panel 56, and is oriented perpendicular to the fold lines 62, 64.

The front panel 60 includes a generally rectangular inner section 68 and a generally rectangular outer section 70. The terms "inner" and "outer" as used herein to describe the sections 68, 70 refer to the orientation of the sections 68, 70 in the outer casing 42 as completely assembled. The outer section 70 is attached to and extends from the edge of the bottom panel 56 opposite to the back panel 54. Advertising information may be imprited on the outer surface of the outer section 70. A fourth fold line 72 extends between and along the entire length of the juncture of the bottom panel 56 and the outer section 70.

The inner section 68 is attached to and extends from the edge of the outer section 70 opposite the bottom panel 56. A double fold line 74 extends between and along the entire length of the juncture of the inner and outer sections 68, 70. As shown in FIG. 5, the length of the inner section 68, in a direction parallel to the double fold line 74, is less than that of the outer section 70. This difference in length forms steps 76.

Attached to and extending from the edge of the inner section 68 opposite the outer section 70 are two rectangular tabs 78 which are laterally spaced apart. Two rectangular openings 80 are formed in the bottom panel 56 with one of the longer sides of each located on the fourth fold line 72. When the outer section 70 and the inner section 68 are folded relative to one another along the double fold line 74, the tabs 78 may be located within openings 80 to latch the inner section 68 to the bottom panel 56.

The side panels 58 are the mirror image of each other and are in the shape of right trapezoids. One of the opposed parallel sides of each side panel 58 is joined to the back panel 54 along one of the fold lines 62, 64. The lower included angles 82 of the side panels 58 are right angles. The angle 84 is acute and the angle 86 is obtuse.

Lateral extensions 88 project from the edges of the side panels 58 between the angles 82, 86 so that they are adjacent the lower edges of the side panels 58. Fifth and sixth fold lines 90, 92 extend between and along the entire length of the junctures of the lateral extensions 88 and the side panels 58.

The extensions 88 comprise first sections 94 located adjacent the fold lines 90, 92 and second portions 96 located remote from the fold lines 90, 92. Measured in a direction parallel to the fold lines 90, 92, the first sections 94 are higher than the second sections 96. The height of second sections 96 (i.e., measured in a direction parallel to fold lines 90, 92) is approximately equal to the dimension of the inner and outer sections 68, 70 of the front panel 60 measured in a direction perpendicular to the fourth fold line 72 and the double fold line 74. In this manner, when the outer casing 42 is folded, the second portions 96 are entrapped between the inner and outer sections 68, 70 and the first portions 94 are aligned with the steps 76.

Flaps 98 are in the shape of right triangles, and are attached to and extend from the edges of side panels 58 located between the angles 84, 86. Double fold lines 100 extend between and along the entire length of the junctures between the side panels 58 and the flaps 98. In its folded condition, the flaps 98 are folded along the lines 100 to lie against the inside surfaces of the side panels 58 to reinforce the side panels 58.

Generally rectangular bottom flaps 102 extend downwardly from the lower edges (i.e., the edges between angles 82) of side panels 58. Seventh and eighth fold lines 104, 106 extend between and along the entire length of the junctures of side panels 58 and bottom flaps 102. The fold lines 104, 106 are perpendicular to the fold lines 62, 64, 90, 92 and are located slightly above and parallel to the fold lines 66. Notches 108 are located in the side edges of the bottom flaps 102 located opposite the bottom panel 56 when the outer casing blank is in its unfolded condition.

The width of the flaps 102 measured in a direction parallel to the fold lines 104, 106 is approximately equal to the distance between the third fold line 66 and the fourth fold line 72. In this manner, when the outer casing 42 is folded, the bottom flaps 102 will lie against the panel bottom 56 with the edges of the bottom flaps 102 adjacent fold lines 104, 106 contacting the inner section 68 of the front panel 60 adjacent the tabs 78 and contacting the back panel 54 adjacent the third fold line 66. This arrangement assists in maintaining the casing 42 in its assembled configuration.

Figure 7:
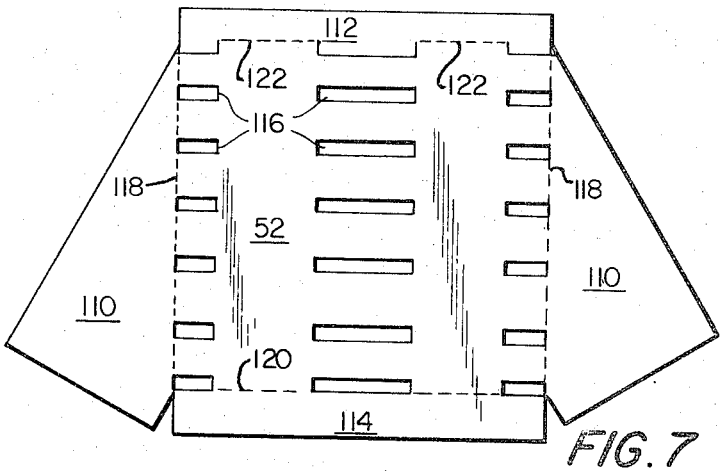
FIG. 7 is a plan view illustrating a blank for the support member of FIG. 1.
Figure 8:
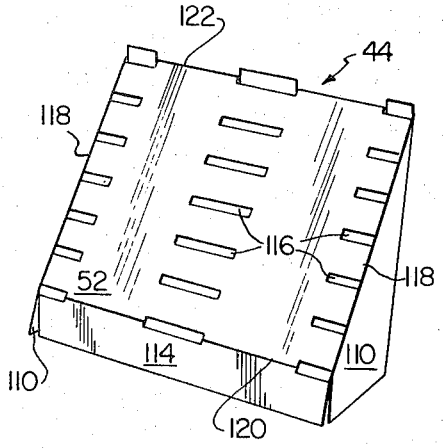
FIG. 8 is a perspective view illustrating the blank of FIG. 7 in its assembled configuration.

The details of the support member 44 will be described with reference to FIGS. 7 and 8. The support member 44 includes a generally rectangular planar support panel 52, two side panels 110, a back panel 112 and a front panel 114. The entire support member 44 is assembled from the blank illustrated in FIG. 7 which is in the form of a flat single unitary sheet of material.

A plurality of rectangular slots 116 are formed in the support panel 52 and are arranged in a plurality of aligned columns and rows. The columns extend up and down the plane of the paper while the rows extend across the plane of the paper as viewed in FIG. 7. Three columns of slots 16 are provided, one adjacent each side edge of the support panel 52 and one extending down the middle of the support panel 52. The slots 116 adjacent each side edge of the side panel 52 are approximately half the length (measured along the length of each row) of the slots 116 in the center column.

Each of the side panels 110 are in the form of a right trapezoid and comprise a portion of generally right triangular shape. The side panels 110 and are attached to and extend from the lateral sides of the support panel 52. Fold lines 118 extend between and along the entire length of the junctures of the side panels 110 and the support panel 52. The fold lines 118 are coextensive with the hypotenuses of the right triangular portions of the side panels 110.

The front panel 114 extends from and is attached to the lower edge of the support panel 52. A fold line 120 extends between and along the entire length of the juncture of the support panel 52 and the front panel 114. The fold line 120 is collinear with the lower longitudinal sides of the slots 116 located in the lowermost row.

The back panel 112 is generally of rectangular configuration and extends from and is attached to the upper edge of the support panel 52. A fold line 122 extends between and along the entire length of the juncture of the support panel 52 and the back panel 112, and bisects the slots 116 located in the uppermost row of the support panel 52.

Figure 9:
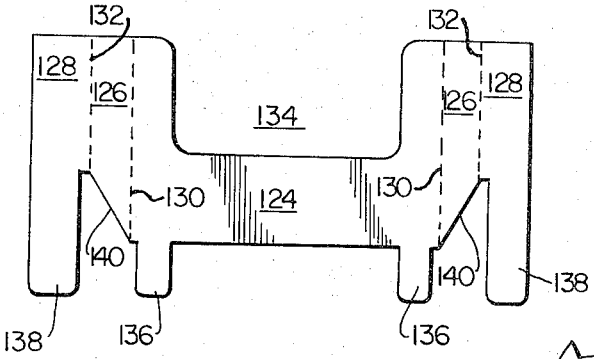
FIG. 9 is a plan view illustrating the blank for the pocket means of FIG. 1.

The details of the pockets 46 will be discussed with reference to FIGS. 9 and 10. The pocket 46 includes a front panel 124, two side panels 126 and two back panels 128. The entire pocket structure 46 is assembled from the blank illustrated in FIG. 9 which is in the form of a flat single unitary sheet of material.

The side panels 126 are attached to and extend from the lateral side edges of the front panel 124. Fold lines 130 extend between and along the entire length of the junctures of the front panel 124 and the side panels 126. The back panels 128 extend from the edges of the side panels 126 opposite the front panel 124. Fold lines 132 extend between and along the entire length of the junctures between the side panels 126 and the back panels 128.

A cutout 134 is located in the upper edge of the front panel 124 to provide maximum exposure of the items to be displayed while retaining sufficient material to support adequately the items in the display rack 40. A pair of legs 136 extends downwardly from the lower edge of the front panel 124 adjacent the fold lines 130. The width of the legs in a direction generally perpendicular to the fold lines 130 is of a size which permits the legs 136 to be received within the slots 116.

In a similar fashion, legs 138 extend downwardly from the lower edges of the back panels 128 and are of a width in a direction perpendicular to the fold lines 132 to permit them to be received within the slots 116.

The lower edges 140 of the side panels 126 are angled upwardly from the fold lines 130 to the fold lines 132. The angular orientation of the lower edges 140 enables the edges 140 to lie against the surface of the inclined support panel 52.

Figure 11:
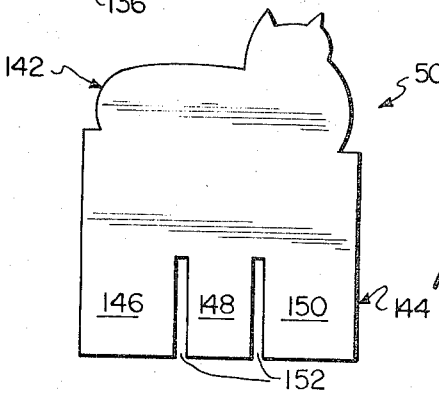
FIG. 11 is a plan view illustrating the blank for the header card for the rack of FIG. 1.

The details of the unitary display card 50 will be discussed with reference to FIG. 11. The display card 50 includes an upper display portion 142 and a lower attachment portion 144. The upper display portion 142 may be of any external configuration and may have advertising information imprinted or otherwise provided thereon.

The lower attachment portion 144 is divided into three section 146, 148, 150 by two elongated slits 152. The slits 152 extend upwardly from the lower edge of the display card 50, through the entire height of the lower attachment portion 144, and terminate at the upper display portion 142.

In order to assemble the display rack 40 of the present invention, the blanks of the outer casing 42, the support member 44 and the pockets 46 are separately folded to their assembled configuration. Once all the necessary parts are folded the support member 44 is placed within the outer casing 42 and the pockets 46 are mounted on the support panel 52. After the header card 50 is mounted on the back panel 54 of the outer casing 42, the items 48 to be displayed may be located in various ones of the pockets 46 to complete assembly of the display rack 40.

Figure 5:
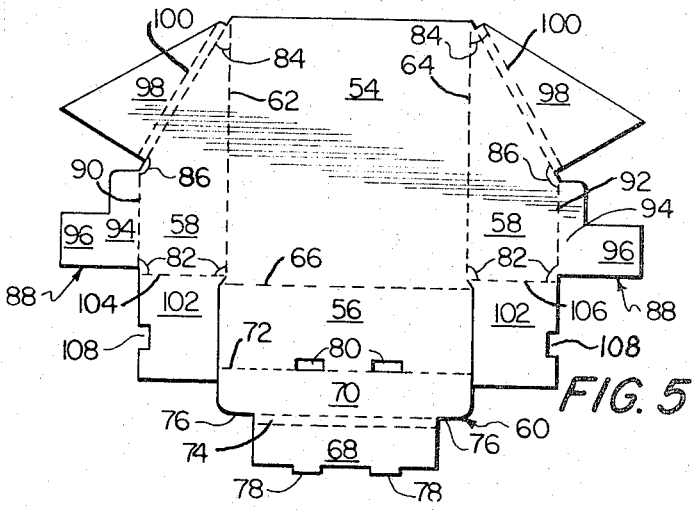
FIG. 5 is a plan view illustrating the blank for the outer casing of FIG. 1.
Figure 6:
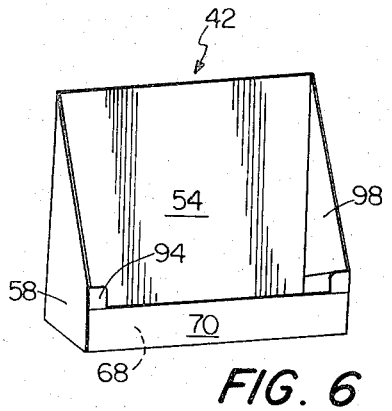
FIG. 6 is a perspective view illustrating the blank of FIG. 5 after it has been folded to its assembled configuration.

To assemble the outer casing 42 to the configuration illustrated in FIG. 6, the blank illustrated in FIG. 5 is folded generally into the plane of the paper. Thus, the outer surfaces of the back panel 54, the side panels 58, and the bottom panel 56 are shown in FIG. 5.

From the position illustrated in FIG. 5, the side panels 58 are folded at lines 62, 64 to form right angles with the back panel 54. The extensions 88 are folded at lines 90, 92 to form right angles with the side panels 58. The bottom flaps 102 are folded at lines 104, 106 to lie against the inside surface of the side panels 58. The bottom panel 56 and the outer section 70 of the front panel 60 are folded at lines 66, 72, respectively, to a position in which the bottom panel 56 is perpendicular to the back panel 54 and the outer section 70 is perpendicular to the bottom panel 56 and parallel to the back panel 54.

In this configuration the front panel inner section 68 is folded at double fold lines 74 and over the second portions 96 of the lateral extensions 88 until the inner section 68 is parallel with the outer section 70. The tabs 78 are then located in the openings 80 to latch the inner section 68 in position.

At this time, the bottom flaps 102 may be pivoted downwardly until they lie against the inside surface of the bottom panel 56 to further secure the inner section 68 in its proper position. To complete the outer casing 42, the flaps 98 are folded at the double fold lines 100 to lie against the inner faces of the side panels 58.

By folding the outer casing 42 in this manner the parts thereof are securely interlocked so that no additional parts are necessary to retain the outer casing 42 in a folded condition. Additionally, the folding operation is simple and may be performed entirely at the site of the display area.

The support member 44 is folded by folding the side panels 110 at fold lines 118 until the side panels 110 are located in planes perpendicular to the plane of the support panel 52. The back panel 112 is folded to an acute angle relative to the support panel 52 at fold line 122 until the lateral edges of the back panel 112 contact the rear edges of the side panels 110. The front panel 114 is folded at fold line 120 until it forms an obtuse angle with the support panel 52 and the lateral edges of the front panel 114 contact the front edges of the side panels 110.

In this manner, the lower edges of the side panels 110 and of the front panel 114 form three sides of a planar rectangular base, which base is oriented at an acute angle relative to the support panel 52. Thus, when the folded support member 44 is located within the folded outer casing 42, the lower edges of the side panels 110 and the front panel 114 will lie against the bottom panel 56 and/or bottom flaps 102 so that the support panel 52 is exposed within the outer casing 42 and is inclined relative to the bottom panel 56. By this arrangement, when the display rack 40 is placed upon a planar, horizontal counter top, the support panel 52 will be inclined relative to such counter top.

After the support member 44 has been placed within the outer casing 42, the display card 50 is mounted on the back panel 54 as illustrated in FIG. 3. This is accomplished by locating sections 146, 150 of the lower attachment portion 144 on the inside surface of the back panel 54 and locating the section 148 on the outside surface of the back panel 54. In this manner, the back panel 54 will extend through the slots 152 and the display card 50 will be retained on the back panel 54 by the inherent resiliency of the materials of the display card 50 and the back panel 54.

Figure 10:
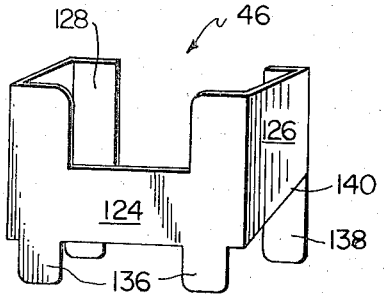
FIG. 10 is a perspective view illustrating the blank of FIG. 9 in its assembled configuration.

The pockets 46 are folded to the configuration illustrated in FIG. 10 by folding the pocket 46 at fold lines 130, 132 until the side panels 126 are perpendicular to the front panel 124 and the back panels 128 are perpendicular to the side panels 126 and parallel to the front panel 124.

In its folded configuration, the back panels 128 are spaced apart and the facing, inside edges of the legs 136, 138 are separated by a distance substantially equal to the distance between the adjacent side edges of a pair of slots 116 located in the same row but in adjacent columns. Also, the opposed inner faces of the legs 136, 138 are spaced apart a distance substantially equal to the distance between adjacent longitudinal sides of a pair of slots 116 located in the same column but in adjacent rows. Thus, when the pocket 46 is mounted on the support panel 52, the legs 136 are located in slots 116 of the same row but adjacent columns, the legs 138 are located within the slots 116 of the row immediately above and in the same columns receiving the legs 136, and the lower edges 140 of the side panels 126 and the lower edge of the front panel 124 lie against the surface of the support panel 52. By locating the legs 136 and the legs 138 of each pocket 46 in four separate slots 116, the material of the support panel 52 therebetween prevents the pocket 46 from collapsing upon it itself.

Since the center column of slots 116 is of double length and slots 116 are provided adjacent each lateral edge of the support panel 52, two columns of pockets 46 may be mounted on the support panel 52 with only these three columns of slots 116. The pockets 46 in each column may be mounted on the support panel 52 to lie against the adjacent pockets 46 in that column as shown in FIG. 2, or may be separated as shown in FIG. 4.

After the desired number of pockets 46 have been mounted on the support panel 52 in the desired arrangement, the items 48 may be placed in groups or separately in individual ones of the pockets 46. In this manner, the items 48 will be displayed in a stairstep fashion.

The display rack 40 of the present invention may be formed of any suitable material, including paperboard or paperboard like material, e.g., corrugated cardboard.

While various embodiments have been chosen to illustrate the invention, it will be understood by those skilled in this art that various changes and modifications can be made therein without departing from the scope of the invention as defined in the appended claims.

What is claimed is:

1. A stairstep display rack for displaying items in a stairstep arrangement on a horizontal surface comprising:

an outer casing;

a support member adapted to be mounted within said casing; said member having a generally planar support panel, means for supporting said support panel so that it is inclined relative to the horizontal surface and exposed in said casing when said member is mounted in said casing, and a plurality of aligned slots in said support panel;

at least one generally channel shaped pocket means for receiving a quantity of items to be displayed; said pocket means including a front panel, two side panels attached to opposite side edges of said front panel and two back panels respectively connected to the remaining side edges of said side panels, said pocket means further including at least two legs extending downwardly from the lower edge thereof and adapted to be received in said aligned slots, and wherein the lower edges of said side panels are inclined upwardly towards said back panels, with the angle of inclination of the lower edges of said side panels being equal to the angle of inclination of said support panel such that the lower edges of said side panels rest against the upper surface of said support panel thereby maintaining said pocket means in a vertical orientation; and said casing, support member and pocket means each being in the form of a flat, planar sheet of material which may be folded to its assembled configuration;

whereby said casing, support member and pocket means may be stored and shipped in a flat configuration, and assembled easily on location without any preassembly.

2. A stairstep display rack according to claim 1 wherein said outer casing comprises a back panel, a bottom panel, two side panels and a front panel;

said side panels are attached to said back panel at opposite side edges thereof, first and second fold lines extend between said side panels and said back panel;

said bottom panel is attached to said back panel at a lower edge thereof, a third fold line extends between said back and bottom panels;

said front panel has inner and outer sections, said outer section is attached to the edge of said bottom panel opposite said back panel, a fourth fold line extends between said bottom panel and said outer section, said inner section is attached to the edge of said outer section opposite said bottom panel, a double fold line extends between said inner and outer sections;

latching means on said front panel inner section and said bottom panel to latch the edge of said inner section opposite said outer section to said bottom panel adjacent said fourth fold line;

lateral extensions projecting from the edges of said side panels opposite said back panel and adjacent said bottom panel, fifth and sixth fold lines extend between said lateral extensions and said side panels, the dimension of at least a portion of each lateral extension in a direction substantially parallel to said fifth and sixth fold lines being approximately equal to the dimension of each of said inner and outer sections of said front panel in a direction substantially perpendicular to said fourth and double fold lines;

whereby said lateral extensions may be entrapped between said inner and outer front panel sections when said outer casing is folded.

3. A stairstep display rack according to claim 2, wherein said latching means comprises at least one tab extending from the edge of said inner section opposite said outer section and at least one opening in said bottom panel adjacent said fourth fold line adapted to receive said tab.

4. A stairstep display rack according to claim 2, wherein generally triangular side flaps are attached to the edges of said side panels opposite said back panel and adjacent said side extensions, double fold lines extend between said side flaps and said side panels;

whereby said side flaps reinforce and lie against the inside surfaces of said side panels when said outer casing is folded.

5. A stairstep display rack according to claim 2, wherein generally rectangular bottom flaps are attached to lower edges of said side panels, seventh and eighth fold lines extend between said bottom flaps and side panels and are generally perpendicular to said first and second fold lines; said bottom flaps having a dimension in a direction substantially parallel to said seventh and eighth fold lines substantially equal to the distance between said third and fourth fold lines;

whereby said bottom flaps are adapted to lie against said bottom panel with edges of said bottom flaps contacting said front panel inner section adjacent said latching means and said back panel adjacent said third fold line when said outer casing is folded.

6. A stairstep display rack according to claim 1, wherein said support panel is generally rectangular and has two side panels attached to opposite side edges thereof, fold lines extend between said side panels and said support panel;

each side panel having a portion generally in the form of a right triangle with the hypotenuses thereof coextensive with their respective fold lines.

7. A stairstep display rack according to claim 6, wherein front and back panels are attached to opposite ones of the remaining edges of said support panel; fold lines extend between said front and support panels and between said back and support panels.

8. A stairstep display rack according to claim 1, wherein said outer casing includes a back panel; and further comprises a unitary header card having an upper display portion and a lower attachment portion attachable to said back panel; said lower attachment portion having two elongated slits which divide said lower portion into three sections, each section attached directly to said upper display portion.

9. A stairstep display rack according to claim 1, wherein said aligned slots are arranged in a plurality of rows and columns.

10. A stairstep display rack according to claim 1 wherein the front panel of said pocket means further includes a cutout along the upper edge thereof to provide maximum exposure of the items to be displayed.

11. A stairstep display rack comprising a generally planar support panel;

means for supporting said support panel at an angle relative to a generally planar surface on which the rack is to be mounted;

a plurality of aligned slots in said support panel;

a plurality of generally channel shaped pocket means said pocket means including a front panel, two side panels attached to opposite side edges of said front panel, and two back panels respectively connected to the remaining side edges of said side panels, said pocket means further including at least two legs extending downwardly from the lower edge thereof and adapted to be received in said aligned slots, and wherein the lower edges of said side panels are inclined upwardly towards said back panels, with the angle of inclination of the lower edges of said side panels being equal to the angle of inclination of said support panel such that the lower edges of said side panels rest against the upper surface of said support panel to maintain said pocket means in a vertical orientation;

at least some of said pocket means arranged in a line extending up the incline of said support panel;

whereby said pocket means are arranged in a stairstep manner.

* * * * *